US005853774A

United States Patent [19]

Dreve

[11] Patent Number: 5,853,774

[45] Date of Patent: Dec. 29, 1998

[54] APPARATUS FOR EXPRESSING A PLASTIC MASS FROM ONE OR MORE CARTRIDGES

[75] Inventor: Volker Dreve, Fröndenberg, Germany

[73] Assignee: Dreve-Otoplastik GmbH, Unna, Germany

[21] Appl. No.: 852,018

[22] Filed: May 6, 1997

[30] Foreign Application Priority Data

Oct. 16, 1996 [DE] Germany ..... 29617872.1
Mar. 6, 1997 [DE] Germany ..... 29704113.4

[51] Int. Cl.[6] ..... B67D 05/44

[52] U.S. Cl. ..... 425/87; 222/137; 222/145.5; 222/333; 222/392

[58] Field of Search ..... 425/87, 458; 222/137, 222/145.5, 145.6, 327, 333, 392

[56] References Cited

U.S. PATENT DOCUMENTS

| | | | |
|---|---|---|---|
| 1,087,572 | 2/1914 | Craven | 222/392 |
| 3,774,809 | 11/1973 | Bratton | 222/392 |
| 3,861,567 | 1/1975 | Davis, Jr. | 222/333 |
| 3,984,033 | 10/1976 | Groth et al. | 222/333 |
| 4,583,934 | 4/1986 | Hata et al. | 222/333 |
| 4,934,827 | 6/1990 | Taschke et al. | 222/137 |
| 5,104,005 | 4/1992 | Schneider, Jr. et al. | 222/137 |
| 5,203,476 | 4/1993 | Keller | 222/333 |
| 5,207,357 | 5/1993 | Aronie et al. | 222/137 |
| 5,263,614 | 11/1993 | Jacobsen et al. | 222/137 |
| 5,341,958 | 8/1994 | Bayat et al. | 222/333 |
| 5,464,128 | 11/1995 | Keller | 222/333 |
| 5,634,531 | 6/1997 | Graf et al. | 222/333 |

*Primary Examiner*—Patrick Ryan
*Assistant Examiner*—Joseph Leyson
*Attorney, Agent, or Firm*—Herbert Dubno

[57] ABSTRACT

A pasty mass such as a mixture of two components of a synthetic resin composition for otoplastic purposes can be displaced from a cartridge by pistons driven by an electric motor within a housing of the device which has a cartridge holder and wherein the pistons are displaced by rotation of a shaft which draws a stainless steel belt and a yoke in the direction of the cartridges to displace the piston rods engaged by that yoke.

11 Claims, 4 Drawing Sheets

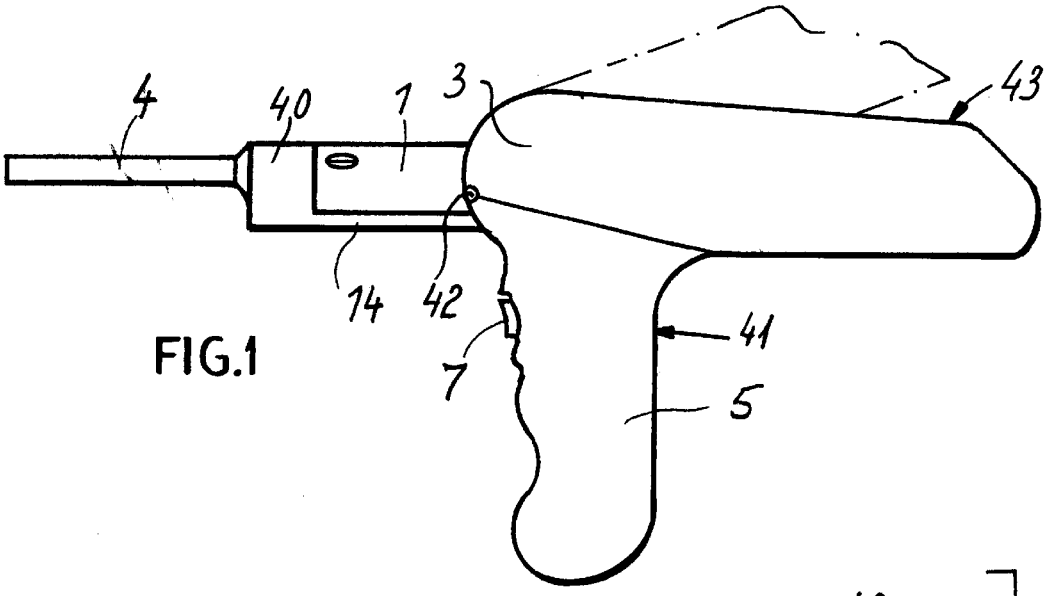
FIG.1
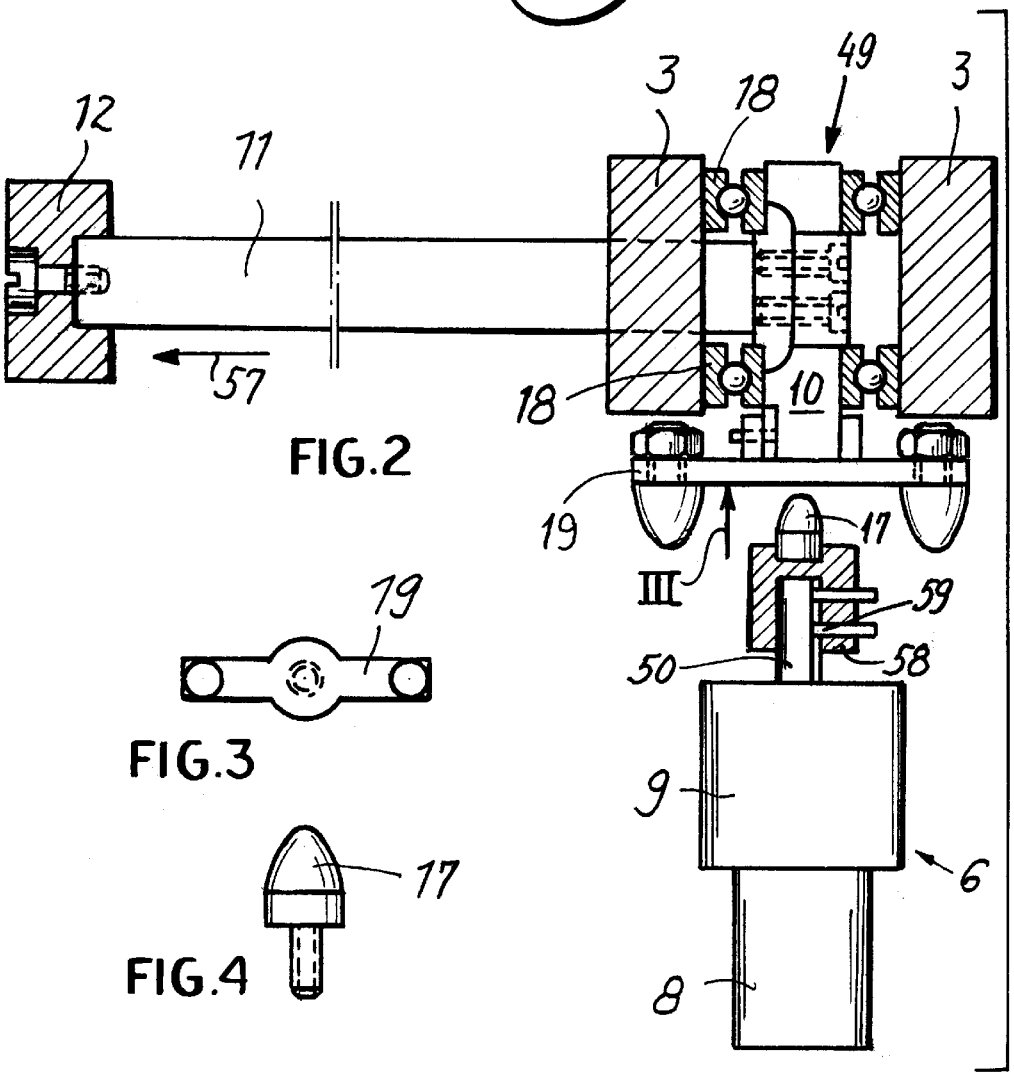
FIG.2
FIG.3
FIG.4

APPARATUS FOR EXPRESSING A PLASTIC MASS FROM ONE OR MORE CARTRIDGES

FIELD OF THE INVENTION

The present invention relates to an apparatus for expressing a plastic mass or a like pasty material, especially for otoplastic purposes, from a single cartridge which may contain two or more components to be mixed, a single-barrel cartridge for a one-component pasty mass, or two cartridges which are to be simultaneously discharged to form a mixture in the form of a settable plastic mass. More particularly, the invention relates to an apparatus of the type in which a piston is contained in a housing and is axially shiftable therein to displace the bottom of the or each cartridge to force the pasty mass from an opening at the opposite end thereof and the housing can have a handle which is transverse to the longitudinal portion of the housing and hence to the axis of the cartridge or cartridges and the piston-displacement direction.

BACKGROUND OF THE INVENTION

Manually actuatable devices for expressing a pasty material from a single cartridge or a pair of cartridge chambers of the type mentioned above are known. In these cases, the handle is provided with a swingable grip member which, when actuated by the fingers of the hand, drives the piston or pistons through an appropriate mechanism and thereby force the pasty material from the cartridge or cartridges. The actuation of this type of device is difficult because the operation of the grip lever often requires considerable force. This is especially the case when the pasty material which must be expressed is a high-viscosity material.

OBJECTS OF THE INVENTION

It is the principal object of the present invention, therefore, to provide an improved apparatus for the purposes described but which can be operated with less applied force in a simpler and more convenient manner than has hitherto been the case.

Another object of the invention is to provide an apparatus which can be used for the convenient extrusion of relatively heavy or highly-viscous materials from cartridges.

SUMMARY OF THE INVENTION

These objects and others which will become apparent hereinafter are attained, in accordance with the invention, with a device for expressing a pasty mass, usually a settable mass of a mixture of two plastic components, which utilizes substantially less manual force than hitherto required by providing in the housing an electric motor drive by means of which the piston or pistons can be displaced from a starting position into an end position, corresponding to complete emptying of the cartridge or cartridges.

More particularly, the apparatus for expressing a pasty mass from a cartridge can comprise:

- a housing having a longitudinally extending portion in which an elongated cartridge containing a pasty mass and having a movable bottom is received;
- a piston in the housing displaceable longitudinally in line with the cartridge and bearing against the bottom to drive the pasty mass out of the cartridge; and
- a drive including an electric motor in the housing operatively connected with the piston for displacing the piston from a starting position corresponding to a full cartridge to an end position corresponding to complete discharge of the pasty material from the cartridge.

Preferably a limit switch is provided on the housing which can be operated when the end position is reached to forcibly de-energize the motor.

Preferably on the handle of the housing a manually-operated switch can be provided which allows the drive to be turned on and off from the exterior.

With the device of the invention, by simple actuation of the start/stop switch, the electric motor drive can be controlled so that electrical energy can be used to displace the piston or pistons. Manual force is practically not required.

Especially when two cartridges or a double-barrel cartridge is provided and the materials expressed from the two chambers are to be forcibly mixed in a mixing head at the outlet side of the cartridges and discharged through a nozzle, considerable force may be necessary to displace the pistons. Utilizing the electric motor drive, a controllable and uniform force can be supplied by the pistons to the material, thereby resulting in a uniform discharge of the material and a thorough mixing in the mixing head.

Especially for the formation of otoplastics, a highly calm and controlled supply of the settable composition is both necessary and obtainable in accordance with the invention. The electric motor drive can be operated in a stepless or stepped manner with preselectable speeds of the continuous displacement for each step in the displacement of the speed adjustment can itself be continuous or stepped. The device of the invention operates highly effectively with very viscous materials. The limit switch, of course, prevents overloading of the drive when the end position is reached.

Advantageously, the drive, comprising the electric motor and a step-down transmission connected to the motor, is received in the handle of the housing and the output shaft of the transmission can be releasably coupled to a driven shaft of the mechanism in the housing by means of which via a flexible tension member, especially a steel band, a yoke can be displaced. The yoke can connect the ends of the piston rods of the two pistons which are displaceable in the respective chambers containing the two viscous masses to be mixed. In this case, the tension member can extend generally codirectionally to the piston rods. The steel band is wound up from the starting position on the drive shaft to displace the piston rods to the respective end positions from the starting position.

The resulting motor-driven unit is simple and inexpensive and utilizes highly reliable elements.

In order to retain the tension member from the end position back into the starting position, the yoke can be provided with a handle so that it can be gripped when an upper portion of the housing is swung away from the lower handle portion and the shafts are decoupled, to unwind the steel band from the driven shaft and return the driven shaft and the piston rods to the starting position.

The lower housing part together with the grip, the cartridge holder, which can be in the form of a pair of parallel half shells receiving the two chambers, and mixing nozzle, can be pivotably connected to the upper housing part which contains the pistons together with the piston rods, driven shafts, tension member and yoke. The upper part can cover the lower part in the closed position of the housing in which the output shaft of the transmission is coupled to the driven shaft.

In the position of the two housing parts where the housing is open, of course, the two shafts are decoupled from one another.

On the driven shaft or the output shaft, a cylindrical pointed-head connector can be fixed via a connection which is noncircular to engage in a complimentarily-shaped recess of the other shaft to form the coupling between the shafts. To enable the effective length of the tension member to be simply matched to the stroke of the pistons, the ends of the tension member, i.e. the steel band, can be fixed on the driven shaft and the yoke by means of clamping elements. In the closed position of the housing, which can be retained by a latch or detent if desired, the shafts are coupled together whereas, upon the simple release of the latch or detent, the shafts can be decoupled.

The insertion of the cartridge can be effected advantageously with the open housing. Once the cartridge is inserted, the housing can be closed and the electric motor drive set in operation by manual actuation of the switch on the handle. The steel band is wound up on the driven shaft and the yoke is thereby drawn toward the cartridge. The piston rods are displaced to force material from the cartridge into the mixing chamber and to force the mixture out of the nozzle. When the end position is reached, the limit switch cuts off the operation of the motor and the tension member can be provided with a spring or a spring may be provided between the tension member and the yoke or between the yoke and the piston rods so that, when the drive is stopped, there is a slight retraction of the pistons from the end positions. The housing can then be opened to decouple the output shaft from the driven shaft and the yoke can be manually retracted so that the piston rods together with the respective pistons are returned to the starting position and the steel band is unwound from the driven shaft. The used cartridge can be replaced by a full cartridge and with closing of the housing, a new operation can be commenced.

For coupling of the output shaft with the driven shaft on closing of the housing, a reliable connection can be provided in that the output shaft of the transmission is formed with an internally polygonal or other noncircular internal cross section on an axially-shiftable spring-loaded coupling sleeve into which a correspondingly-shaped coupling formation on the driven shaft can engage.

If the coupling formation does not enter the sleeve upon closure of the housing, the sleeve is axially displaced and with relative rotation of the sleeve and the coupling formation, the two are brought into registry and the coupling formation can enter the sleeve while the spring expands to ensure full reception of the formation. When the sleeve has a polygonal cross section, the formation can be another sleeve with a polygonal external cross section which can be affixed to the driven shaft. The spring can be a coil spring.

BRIEF DESCRIPTION OF THE DRAWING

The above and other objects, features, and advantages will become more readily apparent from the following description, reference being made to the accompanying drawing in which:

FIG. 1 is a side elevational view of a device according to the invention in the closed position of the housing;

FIG. 2 is a cross sectional view showing a detail of the drive mechanism for the device of FIG. 1 and illustrating the mechanism decoupled from the electric motor drive;

FIG. 3 is a view of the coupling member for the drive shaft as seen in the direction of the arrow III of FIG. 2;

FIG. 4 is a detail elevation of the coupling member of the output shaft of the transmission.

SPECIFIC DESCRIPTION

Figure 5:
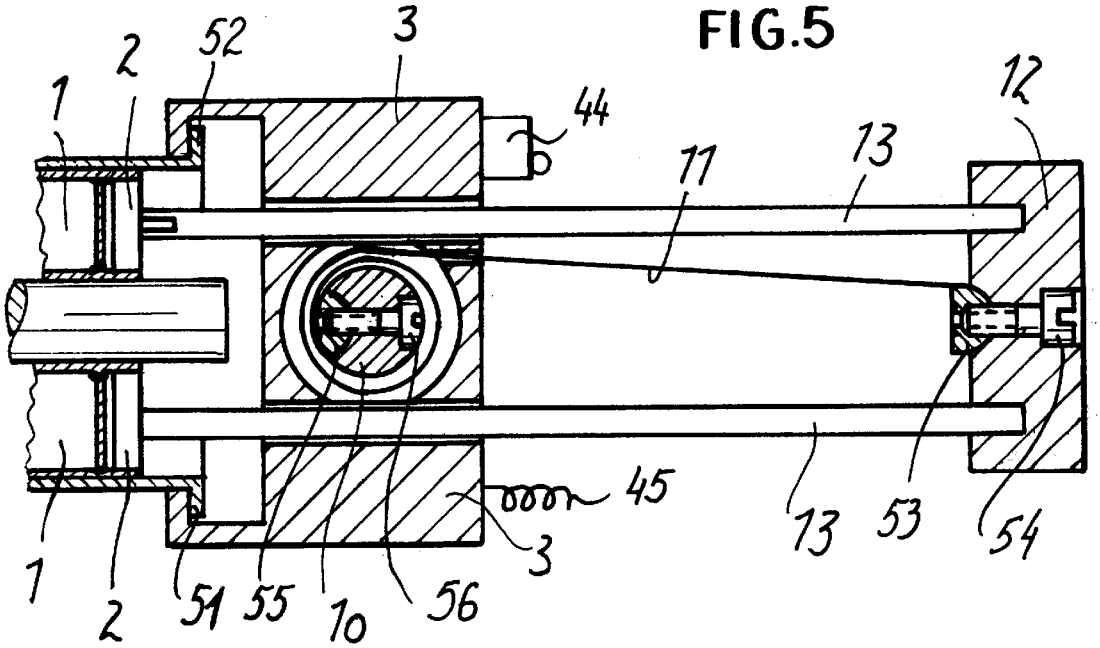
FIG. 5 is a cross sectional view of the mechanism from above.

In the drawing, there is shown a device for expressing a plastic mass or like pasty material from a cartridge 1 which may be a single-barrel cartridge but usually is a double-barrel cartridge containing two components of a settable material which are to be mixed and extruded through a nozzle 4 for, for example, otoplastic purposes.

When a cartridge is referred to herein, therefore, it will be usually mean a double-barrel cartridge having separate chambers for the two components to be intermixed, or two side-by-side cartridges each containing one of the components.

The cartridges have been represented only diagrammatically in FIG. 1 and are seen at 1 in a more structural illustration in FIG. 5.

The material contained in the cartridges can be displaced by pistons 2 bearing against the bottoms of the cartridges and received in a housing 3 which has a holder 14 which can contain the cartridge or two cartridges where appropriate in a double-shell structure. The material can be displaced through a mixing head 40 into the nozzle 4.

As can be seen from FIG. 1 as well, the handle or grip 5 of the housing 3 can be formed on a lower portion 41 of the housing which can also carry the cartridge holder 14 and the nozzle 4 and which can be swingable about a pivot 42 relative to the upper housing portion 43 which, in its upwardly swung position, has been shown in dot-dash lines in FIG. 1.

The pistons 2 are axially displaceable in the housing 3 in the longitudinal direction and in line with the cartridge 1 and the handle 5 extends transversely to the longitudinal direction.

Within the housing 3 an electric motor drive 6 (FIG. 2) is integrated and serves to displace the pistons 2 from their starting position as represented, for example, in FIG. 5, into an end position in which the cartridge is fully emptied. In this end position a yoke 12 can engage a limit switch 44 and bear against a spring 45.

Figure 11:
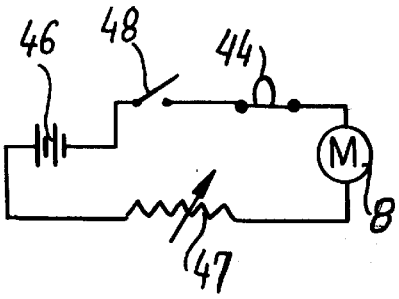
FIG. 11 is a circuit diagram of the device.

As can be seen from FIG. 11, the motor 8 of the electric motor drive can be in circuit with an electric current source 46, for example, a battery in the housing 3, a control 47 for the speed of the motor 8 and a switch 48 for turning on and off the motor. It will be understood that, when the yoke 12 engages the limit switch 44 in the end position of the pistons 2, the circuit is opened and the motor 8 de-energizes. The spring 45 is slightly compressed at this point and urges yoke 12 to the right by a slight extent to draw the pistons 2 also slightly to the right.

The switch 48 has a button 7 on the handle 5 so that it can be actuated, for example, by the index finger of the user.

The drive 6 (FIG. 2) has a transmission 9 of the step-down type connected to the electric motor 8 and, with the electric motor 8, built into the handle 5. Within the upper housing portion 43, a mechanism 49 for displacing the pistons 2 is provided. This mechanism comprises a driven shaft 10 which is releasably coupled to an output shaft 50 of the transmission 9 when the housing 3 is closed, the shaft 10 being disengaged from the shaft 50 when the housing is opened. The driven shaft 10 is connected by a flexible steel band 11 with the yoke 12 to which the piston rods 13 (FIG. 5) are connected. The steel band 11 extends, as can be seen from FIG. 5, generally codirectionally to the piston rods 13.

In the starting position which has been shown in FIG. 5, in which flanges 51 and 52 of the barrels of the cartridges 1 are secured by closure of the housing 3, the steel band 11 is unwound or only partly wound on the driven shaft 10. Since the drive 6 is coupled with the shaft 10, actuation of the button 7 and the switch 48 will energize the motor 8 and drive the shaft 10 to wind up the steel band 11 thereon, drawing the yoke 12 to the left (FIG. 5) and displace the piston rods 13 and the pistons 2 to the left so that the pistons 2 ultimately attain their end positions. The shaft 11 is driven counterclockwise as seen in FIG. 5 for this purpose.

As is also visible in FIG. 5, the yoke 12 can have a clamping bar 53 held by a screw 54 to attachably clamp one end of the band 11 to the yoke. A similar bar 55 on the shaft 11 can be drawn against the other end of the band 11 by the screw 56 to clamp the steel band 11 to the shaft.

To draw the steel band 11 from its end position back into the starting position, a manual system is provided, e.g. the yoke 12 can form a handle which, upon opening of the housing 3, is gripped by the user so that the yoke can be pulled in the direction of arrow 57 (FIG. 2) to unwind the steel band from the shaft 10 which can rotate freely because it is decoupled from the drive 6. The shaft 10 is then rotated in the clockwise sense (FIG. 5).

For coupling of the shafts together in the embodiment of FIGS. 1–5, the driven shaft 50 has a cylindrical pointed-head coupling 17 which can be held in a sleeve 58 keyed to the shaft 50 at 59 and thus enabling the coupling 17 to be connected to the shaft 50 without relative rotation. The pointed-head coupling 17 on a noncircular structure can engage a correspondingly shaped coupling 19 of the shaft 10 as will be apparent from FIGS. 2–4.

Figure 6:
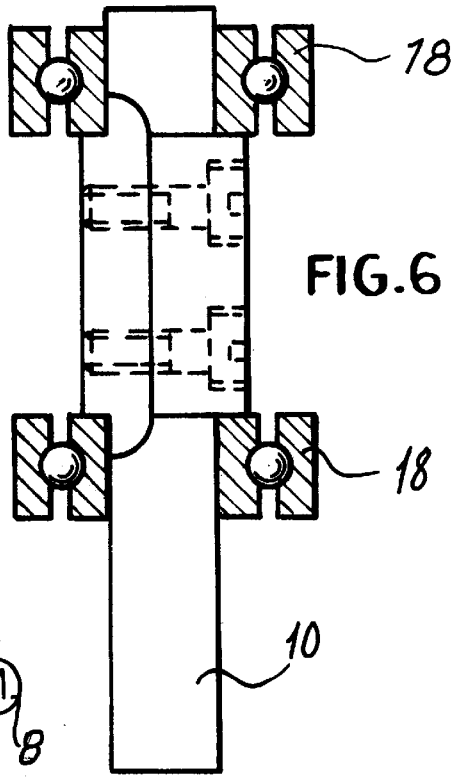
FIG. 6 is an axial section through the bearing system supporting the drive shaft.

As is apparent from FIG. 6, the shaft 10 can be journaled in ball bearings 18 in the upper housing shell. The bearings have been represented diagrammatically in FIG. 2 as well. The members 3 shown in FIGS. 2 and 5 can comprise the housing 3 itself or parts connected thereto.

In the embodiment of FIGS. 7–10, a reliable coupling can be formed upon closure of the housing by providing the output shaft of the transmission 9 with an axially-shiftable spring-loaded coupling sleeve 20 which is provided with an internal polygonal (e.g. hexagonal) recess to receive the coupling formation 21 which has a hexagonal outer cross section. A set screw 23 in a slot 22 holds the sleeve 20 against rotation on the output shaft of the transmission 9 while a set screw 60 holds the formation 21 on the driven shaft 10. The set screw 23 rides in a slot 22 of the sleeve 20 which is biased upwardly by a compression coil spring 24.

Figure 7:
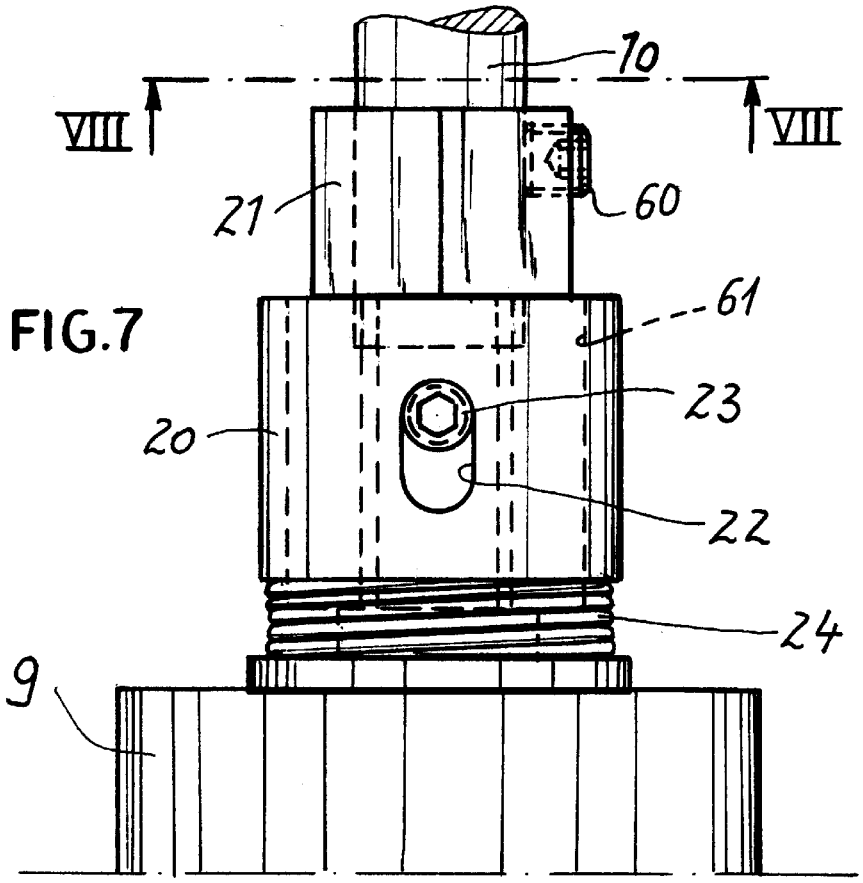
FIG. 7 is a detail of another coupling arrangement in a side elevational view.
Figure 8:
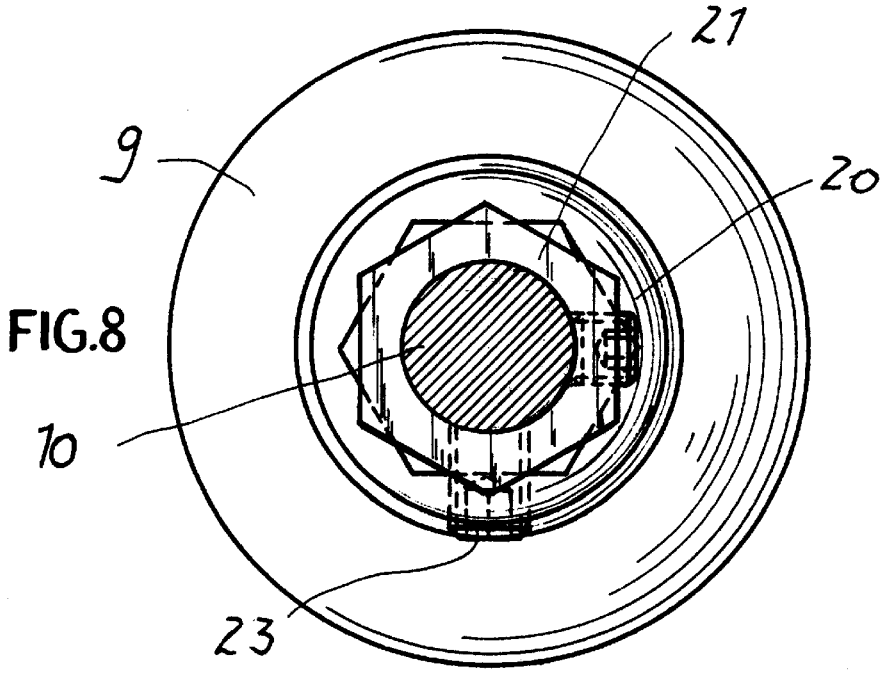
FIG. 8 is a cross sectional view taken along the line VIII—VIII of FIG. 7.
Figure 9:
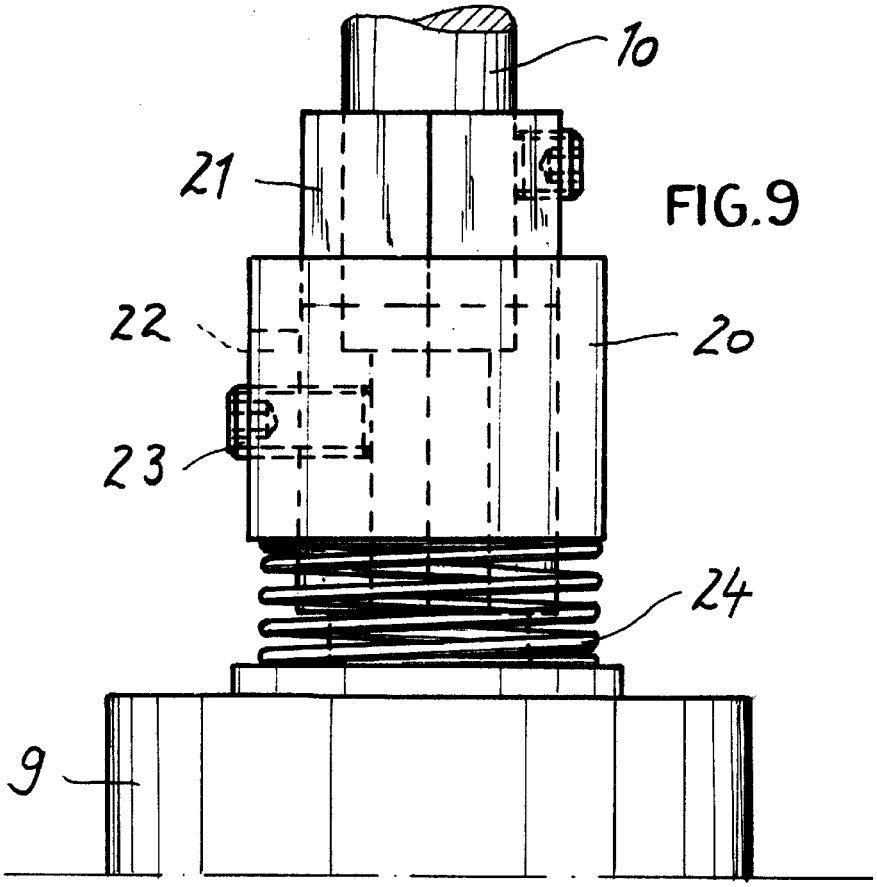
FIG. 9 is a view similar to FIG. 7 but showing the elements in another position.
Figure 10:
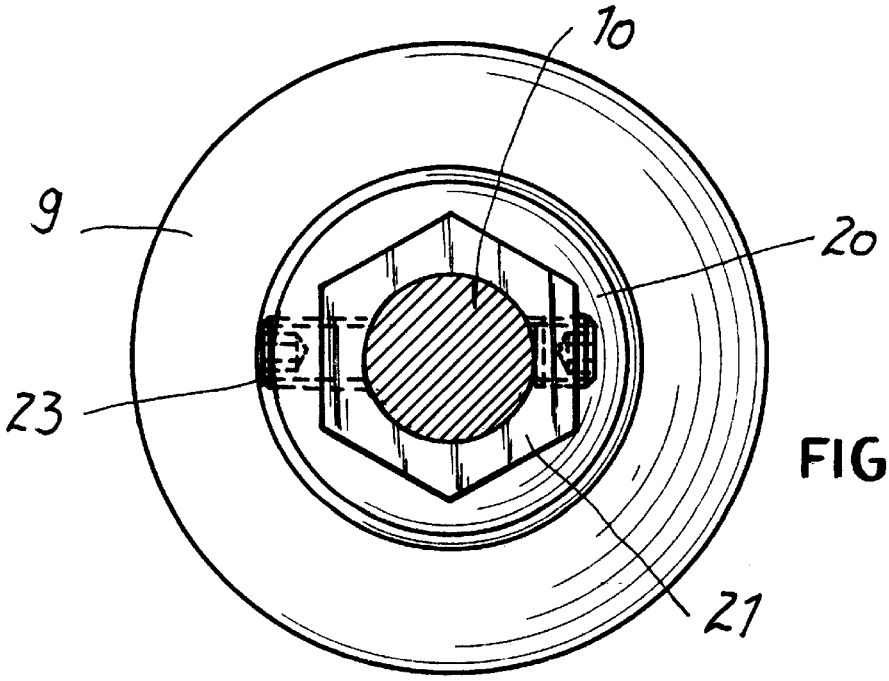
FIG. 10 is a view similar to FIG. 8 but corresponding to the illustration in FIG. 9.

When the housing is closed, the formation 21 may be in register with the hexagonal recess 61 in the sleeve and thus the formation may ride upon the sleeve 20, thereby compressing the spring 24 (FIGS. 7 and 8). With rotation of the sleeve 20 by the motor 6 and the transmission 9, however, the hexagonal socket and formation come into alignment (FIGS. 9 and 10) and the shafts are thereby coupled, with the formation 21 entering the sleeve 20 (FIGS. 9 and 10). The set screw 60 can be countersunk or recessed in the formation 21 so that it does not project radially beyond the latter if desired. The result is a form-fitting connection between the parts 20 and 21 and hence positive drive by the transmission 9 of the shaft 10. Upon opening of the housing the formation 21 easily slides out of the sleeve 20 to separate the two shafts.

I claim:

1. An apparatus for expressing a pasty mass from a cartridge, comprising:

a housing having a longitudinally extending portion in which an elongated cartridge containing a pasty mass and having a movable bottom is received;

a piston in said housing displaceable longitudinally in line with said cartridge and bearing against said bottom to drive said pasty mass out of said cartridge; and a drive including an electric motor in said housing operatively connected with said piston for displacing said piston from a starting position corresponding to a full cartridge to an end position corresponding to complete discharge of the pasty mass from said cartridge, said housing having a handle extending transversely of said longitudinally extending portion, and a cartridge holder on said portion receiving said cartridge and provided with an outlet nozzle for discharging said pasty mass, said apparatus including a second piston operatively connected to said drive, said outlet nozzle being provided with a mixer, and said cartridge holder being capable of receiving at least one cartridge having a pair of cylindrical chambers with respective movable bottoms, each chamber receiving a respective pasty mass and communicating with said mixer, said pistons respectively bearing against said respective movable bottoms, said drive including a speed-reducing transmission connected with said electric motor and a mechanism in said housing for displacing said pistons, said motor and said transmission being received in said handle and said transmission having an output shaft detachably connectable with a driven shaft of said mechanism, said mechanism including a pair of piston rods each connected to a respective one of said pistons, a yoke connecting said piston rods, a flexible tension member connected to said yoke and adapted to be wound on said driven shaft whereby winding of said tension member on said driven shaft displaces said yoke to displace said piston rods until said pistons reach said end position.

2. The apparatus defined in claim 1, further comprising a limit switch in said housing operatively connected with said motor for de-energizing said motor upon said piston reaching said end position.

3. The apparatus defined in claim 1, further comprising a manually-operated switch on said housing for switching on and switching off said motor.

4. The apparatus defined in claim 1 wherein said yoke is formed as a handle enabling said yoke and said pistons, upon decoupling of said shafts, to be drawn manually into said starting position.

5. The apparatus defined in claim 1 wherein said housing has a lower part including said handle, said cartridge holder, said mixer and said nozzle and swingably connected to an upper part of said housing receiving said driven shaft, said piston rods, said tension member and said yoke whereby said upper part substantially closes said lower part in a closed position of said housing and said driven shaft is coupled with said output shaft, said shafts being decoupled in an open position of said housing wherein one of said parts is swung away from the other of said parts.

6. The apparatus defined in claim 1 wherein one of said shafts is formed with a cylindrical pointed-head coupling connected to the respective shaft by a noncircular connection, and engageable in a correspondingly-shaped recess on the other shaft.

7. The apparatus defined in claim 1 wherein the ends of said tension member are fixed to said driven shaft and said yoke by respective clamping elements.

8. The apparatus defined in claim 1 wherein the output shaft of said transmission is formed with a noncircular axially-shiftable spring-loaded coupling sleeve receiving a coupling member on said driven shaft with a corresponding outer cross section whereby upon closure of said housing and engagement of said shafts, said coupling member rides upon said sleeve and compresses the loading spring thereof until, with rotation of said sleeve, said coupling member engages in said sleeve.

9. The apparatus defined in claim 8 wherein said coupling member is a sleeve locked to said driven shaft and having a polygonal outer cross section.

10. The apparatus defined in claim 8 wherein said coupling sleeve has a polygonal inner cross section, is axially shiftable on said output shaft but angularly coupled therewith and is biased toward said driven shaft by a coil compression spring enabling axial displacement of said sleeve.

11. The apparatus defined in claim 1, further comprising a circuit in said housing for electrically energizing said motor and including a switch on said handle for turning said motor on and off and a limit switch in said housing for de-energizing said motor upon said pistons reaching said end position.

* * * * *